United States Patent [19]

Bubik et al.

[11] 4,176,005

[45] Nov. 27, 1979

[54] DOUBLE FILTER PAPERMAKING MACHINE

[75] Inventors: Alfred Bubik, Ravensburg; Siegfried Reutter, Gerbertshaus, both of Fed. Rep. of Germany

[73] Assignee: Escher Wyss GmbH, Ravensburg, Fed. Rep. of Germany

[21] Appl. No.: 973,071

[22] Filed: Dec. 26, 1978

[30] Foreign Application Priority Data

Jan. 16, 1978 [CH] Switzerland ..... 406/78

[51] Int. Cl.[2] ..... D21F 1/24; D21F 9/02

[52] U.S. Cl. ..... 162/256; 162/263; 162/300; 162/301

[58] Field of Search ..... 162/256, 263, 300, 301, 162/352, 198, 203, 217

[56] References Cited

U.S. PATENT DOCUMENTS

| | | | |
|---|---|---|---|
| 3,201,305 | 8/1965 | Webster | 162/203 |
| 3,846,233 | 11/1974 | Kankaanpaa | 162/301 X |
| 3,876,498 | 4/1975 | Justus | 162/203 X |
| 4,033,812 | 7/1977 | Riihinen | 162/301 X |
| 4,055,461 | 10/1977 | Turunen | 162/301 X |
| 4,071,401 | 1/1978 | Babik et al. | 162/300 |

*Primary Examiner*—Richard V. Fisher
*Attorney, Agent, or Firm*—Werner W. Kleeman

[57] ABSTRACT

A double filter papermaking machine comprising two filters guided over a dewatering cylinder. A first one of the filters contains a linear section or path located in front of the cylinder. A domed dewatering or slide shoe, shorter than such linear section, is arranged ahead of the cylinder. The second filter is equipped with an adjustable guide roll, by means of which it is possible to regulate the contact location of the second filter at the first filter, and specifically, between a location disposed at the starting region of the shoe and a location arranged after the shoe at the dewatering cylinder. A regulation device or regulator can be provided which contains a feeler for sensing the position of the water line at the dewatering cylinder. As a function of signals transmitted by the feeler the regulator adjusts the guide roll in a manner such that with a displacement of the water line from a reference position opposite the direction of movement of the filters the contact location is adjusted in the direction of movement of the filters and vice versa.

12 Claims, 3 Drawing Figures

1
2
2'
3
4
5
6
7
8
10
11
12
13
14
17
18
19
20
21
22
23
24
25
26
29
30
A
B
C
S
L1
V

DOUBLE FILTER PAPERMAKING MACHINE

BACKGROUND OF THE INVENTION

The present invention broadly relates to the papermaking art, and, more specifically, concerns a new and improved construction of a double filter papermaking machine, also sometimes referred to in the art as a twin-wire type of papermaking machine.

In particular, the present invention relates to a double filter or twin-wire papermaking machine comprising two endless filters, typically in the form of wires or felts, which serve to guide a fiber web or fleece located therebetween along part of the surface of a dewatering cylinder located below the filters. In front of the cylinder there is located a linear section of the inner filter which is situated closer to the cylinder. This linear section of the inner filter deviates from the horizontal direction through a maximum of 45°. A headbox or equivalent structrue is provided for the inner filter for the infeed of the stock suspension or the like. Between the linear section of the inner filter and the cylinder there is arranged a slide shoe, defining a dewatering shoe, having a curved or domed surface which is curved in the same sense as the cylinder and the radius of which is larger than that of the cylinder. The outer filter which is furthest from the cylinder is provided with an adjustable guide roll which, depending upon its position, enables displacement of the contact line at which the outer filter travels onto the inner filter.

A double filter papermaking machine equipped with a dewatering cylinder and a linear section of an inner filter, located forwardly of the dewatering cylinder, is disclosed in U.S. Pat. No. 3,201,305, granted Aug. 17, 1965 to David R. Webster, reference being specifically made to FIG. 2. With this prior art machine there should be attained a double face dewatering of the formed paper web, and specifically, along the linear section under the influence of the force of gravity and at the dewatering cylinder by the filter tension and the centrifugal force. This state-of-the-art machine has the advantage that guiding of the filters occurs with low friction, since there does not exist any friction between the filter and the rotating filter which revolves with the same peripheral speed. The dewatering effect at the web or fleece however occurs suddenly upon reaching the cylinder surface. This is associated with a series of drawbacks, for instance the formation of so-called needle or pin holes.

On the other hand, in U.S. Pat. No. 4,033,812, granted July 5, 1977, and assigned to the Finnish firm Valmet Oy, there is disclosed a double filter or twin-wire papermaking machine wherein the dewatering effect due to filter tension and centrifugal force predominantly occurs at a shoe over which slide the filters. The subsequent arranged cylinder only is assigned the task of post-drying the paper fleece or web. Additionally, there is provided an adjustable guide roll enabling a partial pivoting of the upper filter from the shoe. However, this guide roll only has the function of enabling displacement of a carriage with the outer filter from the inner filter. With this paper machine it is possible, by selecting the radii of the surface of the shoe, to influence the course and magnitude of the pressure forces of both filters acting upon the fiber web or fleece. The movement of the filter over a stationary shoe with the required large filter extent is however associated with the formation of large frictional forces and appreciable wear of the shoe and the filter. Fabrication of a shoe having different radii constitutes a decisive technological problem.

SUMMARY OF THE INVENTION

Therefore, with the foregoing in mind, it is a primary object of the present invention to provide a new and improved construction of a double filter papermaking machine which is not associated with the aforementioned drawbacks and limitations of the prior art constructions.

Another and more specific object of the present invention aims at the provision of a double filter papermaking machine of the previously mentioned type which avoids the drawbacks of both aforementioned double filter paper machine constructions and enables the dewatering to occur while extensively avoiding surface friction at the revolving cylinder, yet nonetheless permits a gentle application of the dewatering force of the filters and specifically in an adjustable manner.

Yet a further significant object of the present invention is to devise a novel construction of twin-wire papermaking machine which enables the dewatering effect to be applied in a more controlled and protective manner to the paper web which is being formed at the machine.

Now in order to implement these and still further objects of the invention, which will become more readily apparent as the description proceeds, the papermaking machine of the present development is manifested by the features that the slide shoe is arranged directly in front of the cylinder, and that the adjustable guide roll permits an adjustment of the contact line between a starting region of the shoe and a location disposed externally of the shoe at the cylinder.

As already mentioned, the actual dewatering occurs at the cylinder which rotates and therefore does not cause any or any appreciable friction between the filter and its surface. The short slide shoe which has a large radius brings about in conjunction with a small wedge angle of the running together filters a gentle application of the dewatering force. In this way there can be beneficially avoided the formation of the aforementioned needle or pin holes and other unacceptable or intolerable phenomena at the formed paper web. Due to the provision of the adjustable guide roll it is possible to adjust the effective length of the shoe or to completely eliminate the effect thereof, as the case may be. Consequently, there is possible optimum accommodation to the momentarily encountered operating conditions.

Preferably, the slide shoe, viewed in the direction of movement of the filter, can possess a length which amounts to 0.5 to 1.5-fold the circumferential length of the cylinder contacted by the inner filter, and with the slide shoe length shorter than the length of the linear section of the inner filter. The diameter of the cylinder then can be in the order of about 1000 to 2000 mm. Due to the relatively short extent of the slide shoe in the direction of movement of the filter and the large diameter of the cylinder there is optimally realized the strived for distribution of the pressures between the cylinder and the shoe.

The shoe can possess a curved surface constituting part of a circular cylindrical surface having essentially constant diameter and which amounts to at least twice the diameter of the cylinder. Such circular cylindrical surface having a single diameter has the particular noteworthy advantage that, in contrast to the shoe surface of the aforementioned U.S. Pat. No. 4,033,812 having increasing curvature, it can be fabricated much more simply. However, it should be understood that the invention is not limited to this construction, and specifically, it is also possible to use such type surface having different continuously mutually merging diameters.

The dewatering cylinder either can be constituted by a solid surface or a surface having blindhole bores. Which of both constructions is to be preferred is dependent upon the quantity of water which is to be taken-up and thus predominantly upon the surface weight of the paper which is to be fabricated. However, it is to be understood that in conventional manner it is also possible to provide a suction roll or a roll having a continuously throughbored roll shell or outer surface possessing a blowing action.

At the region of the location where both filters depart from the dewatering cylinder there can be arranged a catch container for the filtered water. At increased filtering velocities this catch container prevents any of the expelled water droplets from dropping back onto the filters and therefore avoids any disturbance at the formed fiber web or fleece.

Moreover, the angle of wrap of both filters about the cylinder can amount to at most 90°. With a cylinder size as is preferably employed with the machine of the present invention, there is already realized with such size angle of wrap a sufficient dewatering effect, and additionally there is further afforded the advantage that there is present an inclined downwardly extending course of the filter after the cylinder which, in turn, appreciably facilitates the removal of the paper web from the inner filter.

At relatively long linear sections of the inner filter there can be preferably provided a sequential or tandom arrangement of dewatering elements possessing increasing intensity of their dewatering effect. Preferably, this can be constituted by a dewatering section or region acting by means of the force of gravity, a section or region having foil means or foil strips or equivalent structure and a section or region embodying at least one suction box. In this way there is obtained a protective course of the dewatering action in the one direction, which augments the formation of the web at the filter, and in the same manner as a similar type course of the dewatering effect in the other direction due to the tandom arrangement of the shoe and the cylinder. Both measures enable fabricating paper having essentially the same properties at both sides or faces thereof while utilizing a simple construction of extremely accommodatable papermaking machine having low power requirements for the drive of the filters and high service life of the filters.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 3:
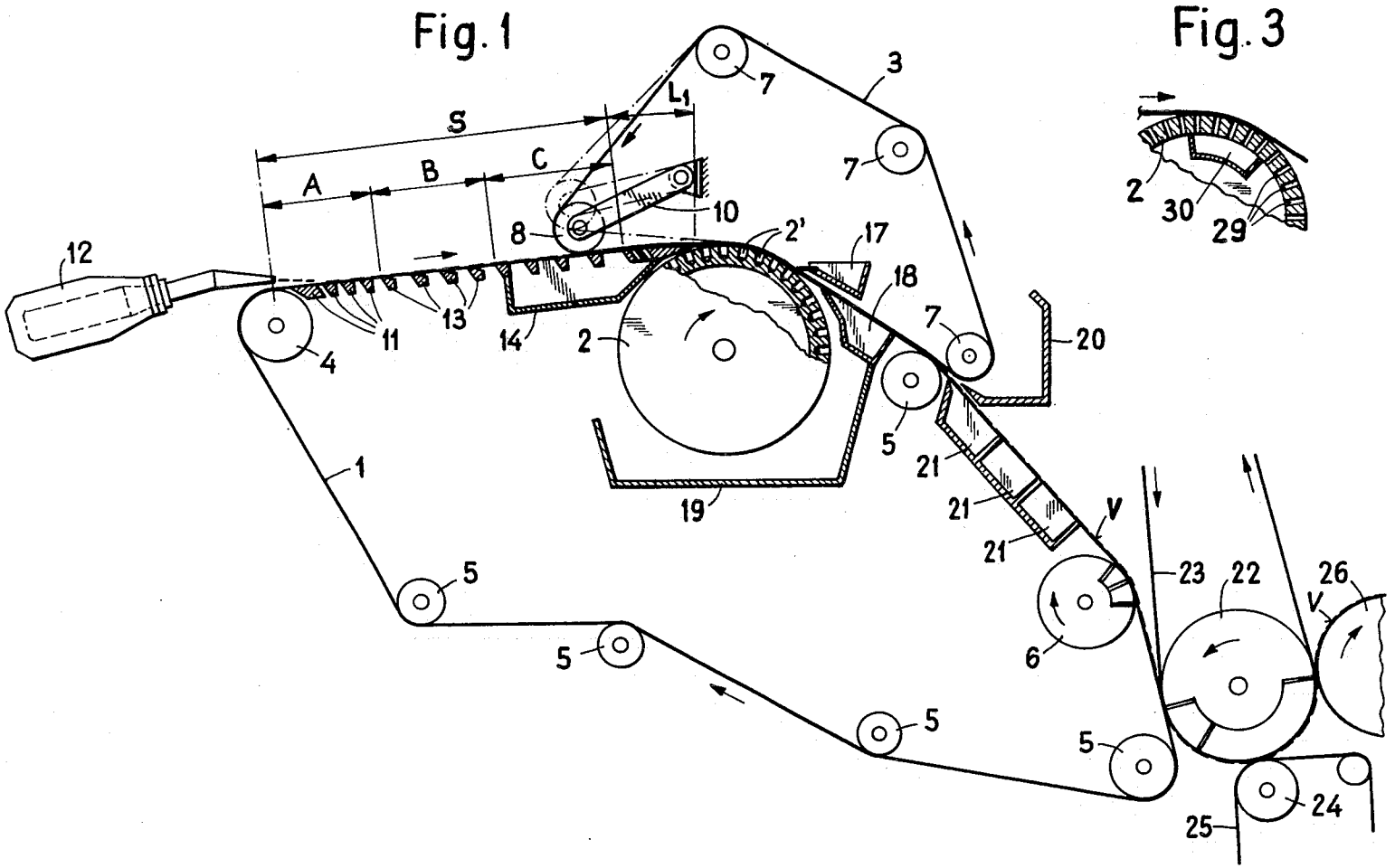
FIG. 1 is a schematic illustration of a double filter or twin-wire papermaking machine according to the invention.
FIG. 3 is a fragmentary section showing a modified portion of the papermaking machine of FIG. 1.

Describing now the drawings, it is to be understood that for purposes of simplifying the illustration of the double filter papermaking machine only enough of the construction thereof has been shown to enable those skilled in the art to readily understand the underlying principles and concepts of the present invention. Turning attention to FIG. 1, the therein illustrated double filter or twin-wire papermaking machine will be seen to comprise an inner filter 1, typically in the form of a wire, felt or mesh or other suitable liquid pervious structure and defining a web-carrying means. The inner filter 1 wraps partially about a dewatering cylinder 2. Further, there is provided an outer filter 3, likewise typically in the form of a wire, felt or mesh or other suitable liquid pervious structure and defining a web-pressing element. The outer filter 3 cooperates with the inner filter 1 at the region of the dewatering cylinder 2.

The inner or first filter 1 is guided over a breast roll 4, the dewatering cylinder 2, guide rolls 5, of which one is constructed in known manner as a tensioning roll, as well as a suction cylinder 6. The outer or second filter 3, located furthest from the dewatering cylinder 2, is guided over guide rolls 7, of which one likewise can be constructed as a tension roll, as well as over an adjustable guide roll 8 or equivalent structure. This adjustable guide roll 8 is rotatably mounted at a pivotable arm or lever 10 which enables the guide roll 8 to move between the full line illustrated position of FIGS. 1 and 2 into the phantom line illustrated position of such FIGS. 1 and 2.

As particularly well seen by referring to FIG. 1, a substantially linear section S of the inner or first filter 1 merges with the breast roll 4. This essentially linear section S is subdivided into three parts or regions, namely a region A provided with conventional filter dewatering tables 11 or equivalent structure, at which there is accomplished dewatering of the fiber web formed by a headbox 12 by the action of the force of gravity, a region B provided with standard foils or foil strips 13, and a region C having at least one suction box 14.

Figure 2:
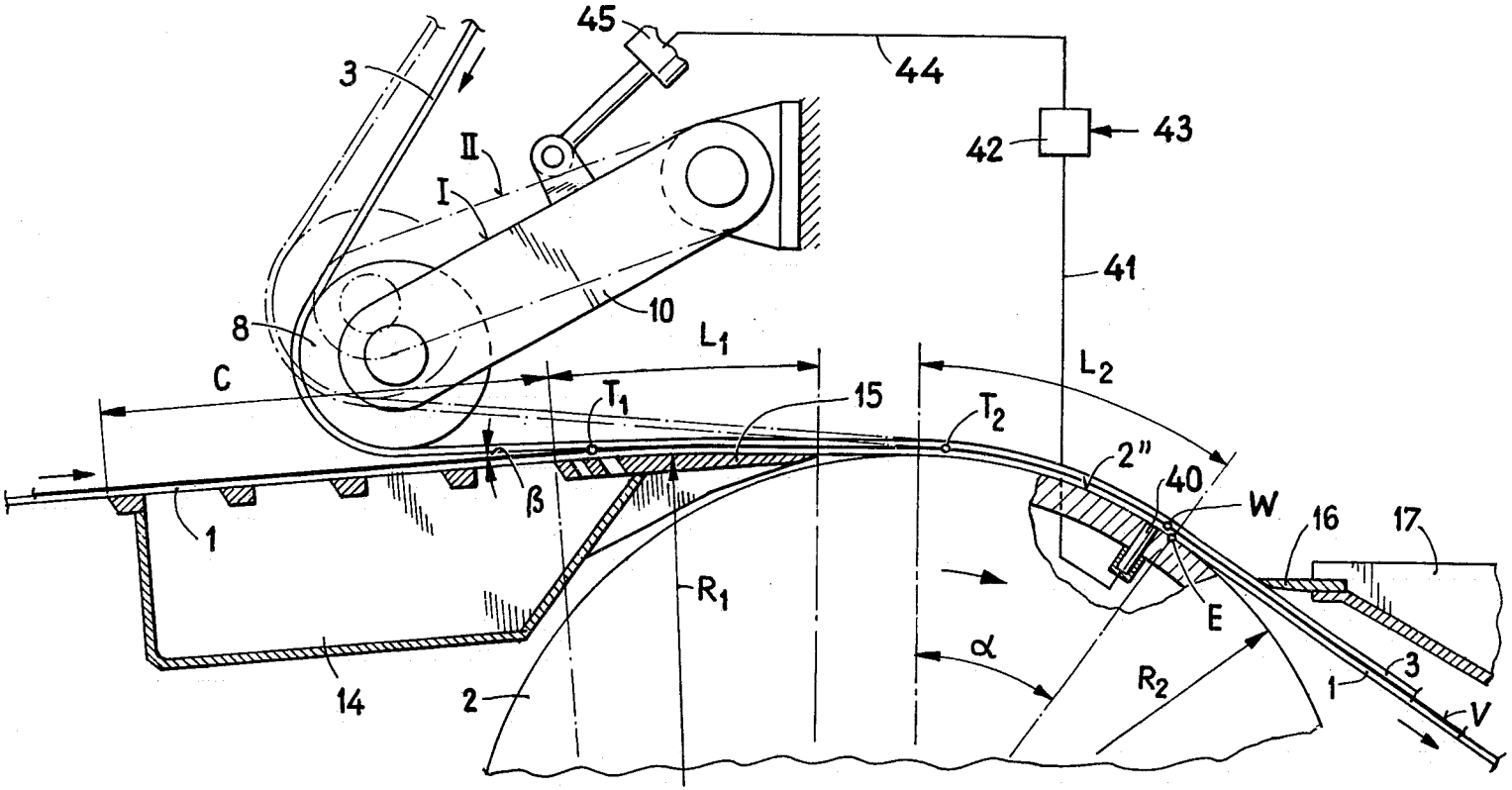
FIG. 2 illustrates on an enlarged scale part of the papermaking machine shown in FIG. 1 with a somewhat modified form of a dewatering cylinder.

At the part or region C equipped with the suction box 14 there merges a dewatering or slide shoe 15, as clearly shown in FIG. 2. This slide shoe 15, viewed in the direction of movement of the first filter 1, possesses a curved surface or domed portion having a radius $R_1$. The slide shoe 15 is preferably arranged as closely as possible to the dewatering cylinder 2 and has a length $L_1$ measured along its surface. The filter 1 arrives from the slide shoe 15 at the dewatering cylinder 2 where it is wrapped thereabout along a wrap angle $\alpha$. With a diameter $R_2$ of the dewatering cylinder 2 there thus is formed a wrap length $L_2$ measured at the surface of the dewatering cylinder 2. At the region of the location E, where both of the filters 1 and 3 are lifted off the surface of the dewatering cylinder 2, the outer or second filter 3 is contacted by the lip 16 of a catch or receiving container 17 for the spray or filtered water. Below the filters 1 and 3 there is disposed a support element 18, which can be constructed as a suction box, and also there is arranged below these filters a catch or receiver container 19.

Following the guide roll 5 of the inner filter 1 which is located opposite the guide roll 7, the outer filter 3 is raised from the inner filter 1 and returned upwardly at an inclination. A catch container 20 prevents undesired spraying of the fiber web or fleece V which now reposes upon the filter 1. Below the filter 1 there is located at this region or section suction boxes 21 which can work at different negative pressures. Following the suction boxes 21 is the suction cylinder 6 where the dewatering of the fiber web is further continued.

After the suction cylinder 6 the filter 1 is contacted by a suction and press cylinder 22 which ensures for the transfer of the fiber web or fleece V to a pick-up felt 23 or equivalent structure. There coact in conventional manner with the cylinder 22 a press or contact roll 24 having a press felt 25 as well as a granite press or contact roll 26 from which the fiber web V is then fed to a not particularly illustrated but conventional drying device.

As best seen by referring to FIG. 2, the pivotal arm or lever 10 of the pivotable guide roll 8 is adjustably positionable between the position I shown in full lines and the phantom line illustrated position II. Depending upon the position of the pivotal arm or lever 10 the outer filter 3 travels onto the inner filter 1 between the contact lines corresponding to the terminal or end positions, these lines being illustrated in FIG. 2 by the points $T_1$ and $T_2$. The point $T_1$, which corresponds to the end or terminal position I, is located at the starting region of the slide shoe 15, and owing to the curved surface or doming of the shoe 15 between the filters 1 and 3 there is formed a small contact angle $\beta$. The point $T_2$, corresponding to the position II, is located externally of the slide shoe 15 at the cylinder 2. In this position there is thus effectively functionally disconnected the slide shoe.

During operation the fiber web or fleece V formed by the headbox 12 is initially dewatered in its downward direction, i.e. towards the lower face or side thereof at the straight or linear section S, and specifically, with increasing intensity firstly by the action of the force of gravity, then by the foils or foil strips 13 and finally by the action of the suction box 14. Thereafter there follows a dewatering of the fiber web V towards the top, and specifically, initially at a lower pressure force due to the filter tension and the centrifugal force at the slide shoe 15, thereafter with a greater intensity at the dewatering cylinder 2. The gradual pressure increase during dewatering towards the top or upper face of the fiber web is further augmented by the small contact angle $\beta$ between the filters 1 and 3 following the adjustable guide roll 8. The upper filter 3, during operation, is gently deposited upon the lower filter 1 before there occurs the relevant dewatering pressure following the contact line, for instance the line $T_1$.

In this way there is obtained a paper which can have extensively the same properties at both of its faces or sides. Moreover, the dewatering towards the top predominantly occurs at the dewatering cylinder 2 which rotates in conjunction with the filter 1, and thus, does not produce any or any appreciable friction. The slide shoe 15 which ensures for a gradual or gentle ascent of the dewatering pressure is maintained short and is only limited to this function. Additionally, the second filter 3 can be raised at the region of such slide shoe 15, so that the effective length of the slide shoe 15 can be made shorter or longer depending upon requirements. Consequently, there are not only obtained improved operating characteristics of the equipment, but furthermore the sliding friction at the papermaking machine is limited to a minimum.

As will be readily seen by comparing FIGS. 1 and 2 the dewatering cylinder 2, as shown in FIG. 1, can be provided with blindhole bores 2' serving for the take-up of water which thereafter can flow-off or can be sprayed-off. However, as shown in FIG. 2, the dewatering cylinder 2 also can have a solid smooth outer surface 2''. With the showing of FIG. 3 there is illustrated a construction wherein the dewatering cylinder 2 possesses continuous bores 29 and has at least one suction box 30.

The structure of the formed paper web is determined at a location following the dewatering cylinder 2. The suction boxes 18 and 21 and the suction cylinder 6 only augment dewatering of the paper web, do not however influence such structure any longer.

As also seen from a comparison of FIGS. 1 and 2, the linear section S of the filter 1 is longer than the peripheral length $L_1$ of the slide or dewatering shoe 15. The peripheral or circumferential length $L_1$ of the slide shoe 15, in turn, is approximately the same as the circumferential length $L_2$ of the cylinder 2 which is contacted by the inner filter 1. The length $L_1$ can amount to 0.5 to 1.5-fold the length $L_2$.

FIG. 2 shows still a further possibility for regulating such type papermaking machine. According to FIG. 2 there is incorporated into the cylinder 2 a pressure feeler or sensor 40 which rotates in conjunction with the cylinder 2 and has been schematically shown in the drawing connected by a signal line or conductor 41 with a regulator 42. It should be understood that for transmitting the measuring signals from the pressure feeler 40 to the regulator 42 there can be used, by way of example, a slip ring or a different device for transmitting measuring signals from a rotating part to a stationary part. The regulator or regulating device 42, which is set so as to have a reference value 43, serves for actuating a servo motor 45 by means of a line or conductor 44 which positionally adjusts the pivotal arm 10 and thus the guide roll 8.

During its movement the pressure feeler 40 serves for sensing the position of the water line W which, during operation, should be located slightly in front of the point E. If the filters and the fiber web still contain free water, i.e., are located in front of the water line W, then the pressure feeler 40 senses an hydraulic pressure. At the region of the water line there occurs a pronounced reduction of this pressure.

The regulation operates in the manner that with a displacement of the water line from the desired position towards the front opposite the direction of movement of the filters the arm or lever 10 is raised in the direction of position II. If conversely the water line moves from the desired position towards the point E, then the arm or lever 10 is thereafter adjusted into the position I.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A double filter papermaking machine comprising:

two endless movable filters defining a first filter and a second filter;

a dewatering cylinder positioned below and cooperating with said two endless filters;

said two endless filters serving to guide a paper web located therebetween along part of the surface of the dewatering cylinder;

said first filter defining an inner filter located closer to said dewatering cylinder than said second filter;

said first filter having a linear section disposed forwardly of the filter and deviating from the horizontal direction by at most 45°;

headbox means cooperating with the first filter for the infeed of a stock suspension for forming the paper web;

a slide shoe having a curved surface;

said slide shoe being arranged between said linear section and said dewatering cylinder;

said curved surface of said guide shoe being curved in the same direction as said dewatering cylinder and having a radius which is larger than the radius of the dewatering cylinder;

said second filter defining an outer filter located further from said dewatering cylinder than said first filter;

an adjustable guide roll cooperating with said second filter;

means for adjusting the position of said guide roll;

said guide roll, depending upon its position, enabling displacement of a contact line defining the location where the outer filter contacts the inner filter;

said slide shoe being arranged directly forwardly of said dewatering cylinder; and said adjustable guide roll enabling an adjustment of the contact line between a starting region of the slide shoe and a location at the dewatering cylinder disposed externally of the slide shoe.

2. The double filter papermaking machine as defined in claim 1, wherein:

said slide shoe, viewed in the direction of movement of the two filters, possesses a length amounting to about 0.5 to 1.5-fold the circumferential length of the dewatering cylinder which is contacted by the inner filter and shorter than the length of the linear section.

3. The double filter papermaking machine as defined in claim 1, wherein:

said dewatering cylinder possesses a diameter in the order of about 1000 to 2000 mm.

4. The double filter papermaking machine as defined in claim 1, wherein:

said curved surface of said slide shoe constitutes part of a substantially circular cylindrical surface having an essentially constant diameter which amounts to at least twice the diameter of the dewatering cylinder.

5. The double filter papermaking machine as defined in claim 1, wherein:

said dewatering cylinder possesses a solid outer surface.

6. The double filter papermaking machine as defined in claim 1, wherein:

said dewatering cylinder possesses an outer surface provided with blindhole bores.

7. The double filter papermaking machine as defined in claim 1, wherein:

both of said filters depart from said dewatering cylinder at a predetermined location; and a catch container for filtered water arranged at the region of said predetermined location.

8. The double filter papermaking machine as defined in claim 1, wherein:

both of said filters are trained about the dewatering cylinder through a wrap angle which at a maximum amounts to 90°.

9. The double filter papermaking machine as defined in claim 1, further including:

dewatering elements arranged in succession at the region of the linear section of the inner filter; and said dewatering elements having an increasing intensity of their dewatering action which they exert upon the paper web.

10. The double filter papermaking machine as defined in claim 9, wherein:

said dewatering elements arranged in succession at the region of the linear section of the inner filter comprise, in the direction of movement of said inner filter, a dewatering section effective by the action of the force of gravity, a section equipped with foil means and a section equipped with at least one suction box.

11. The double filter papermaking machine as defined in claim 1, further including:

measuring means for determining the position of a water line at a region of the dewatering cylinder about which there are trained both of the filters;

regulating means including adjustment means for adjusting the position of the contact line as a function of the position of the water line such that with displacement of the water line from a reference position opposite the direction of movement of the filters the contact location is adjusted in the direction of movement of the filters and vice versa.

12. A double filter papermaking machine comprising:

two endless movable filters defining a first filter and a second filter;

a dewatering cylinder positioned below and cooperating with said two endless filters;

said two endless filters serving to guide a paper web located therebetween along part of the surface of the dewatering cylinder;

said first filter defining an inner filter located closer to said dewatering cylinder than said second filter;

said first filter having a linear section disposed forwardly of the filter;

means cooperating with the first filter for the infeed of a stock suspension for forming the paper web;

a slide shoe having a curved surface;

said slide shoe being arranged between said linear section and said dewatering cylinder;

said curved surface of said guide shoe being curved in the same direction as said dewatering cylinder and having a radius which is larger than the radius of the dewatering cylinder;

said second filter defining an outer filter located further from said dewatering cylinder than said first filter;

an adjustable guide element cooperating with said second filter;

means for adjusting the position of said guide element;

said guide element depending upon its position, enabling displacement of a contact line defining the location where the outer filter contacts the inner filter;

said slide shoe being arranged forwardly of and relatively near to said dewatering cylinder; and said adjustable guide element enabling an adjustment of the contact line between a predetermined region of the slide shoe and a location at the dewatering cylinder disposed externally of the slide shoe.

* * * * *